US005385686A

United States Patent [19]

Miller et al.

[11] Patent Number: 5,385,686

[45] Date of Patent: Jan. 31, 1995

[54] SPARK PLUG BOOT WITH IMPROVED LUBRICANT

[75] Inventors: Laurie-Jo Miller, West Farmington; Brian R. Sabo, Vienna; Bruce S. Gump; Jerry J. DeSalvo, both of Warren, all of Ohio

[73] Assignee: General Motors Corporation, Detroit, Mich.

[21] Appl. No.: 76,657

[22] Filed: Jun. 14, 1993

[51] Int. Cl.[6] ..... C10M 105/54

[52] U.S. Cl. ..... 252/54; 252/49.6

[58] Field of Search ..... 252/54, 49.6

[56] References Cited

U.S. PATENT DOCUMENTS 3,981,812 9/1976 Zletz ..... 252/49.6

5,032,302 7/1991 Juhlke et al. ..... 252/54

OTHER PUBLICATIONS

"Krytox" GPL 20/50 X Series & GPL) X Series Fluorinated Greases, Du Pont Chemicals, Material Safety Data Sheet, 5660 APP Revised 13 Dec. 1990 Printed 03 Jun. 1992.

Krytox General Purpose Fluorinated Lubricants, Vendor brochure, dated prior to Feb. 5, 1993.

*Primary Examiner*—Stephen Kalafut

*Assistant Examiner*—Cephia D. Toomer

*Attorney, Agent, or Firm*—Cary W. Brooks

[57] ABSTRACT

The invention is directed to a spark plug boot with an improved lubricant including a perfluoroalkylpolyether, which may be blended with an extender such as a polydimethylsiloxane grease. A mixture of ratios can be utilized for desired characteristics ranging from 100:0 to 25:75 weight percent perfluoroalkylpolyether to polydimethylsiloxane.

6 Claims, 1 Drawing Sheet

SPARK PLUG BOOT WITH IMPROVED LUBRICANT

FIELD OF THE INVENTION

This invention relates to spark plug boots with improved lubricants or greases, and more particularly, to a lubricant, including a thickened perfluoroalkylpolyether which may be blended with an extender, such as a polydimethylsiloxane grease.

BACKGROUND OF THE INVENTION

There are a variety of types of physical barriers that have been used as release agents in the spark plug-to-spark plug boot interface in automotive applications. The two primary purposes of the physical barrier are to improve the dielectric capability of the interface and to prevent the spark plug and spark plug boot from bonding to each other. Heretofore, greases and powders have been put in the boots, and fluorotelomer coatings have been put on spark plugs. However, such techniques do not meet desired characteristics for a superior release agent. Preferably, the desired characteristics of a superior release agent are as follows:

1) provide excellent dielectric capability;
2) prevent spark plug-to-spark plug boot bonding;
3) sustain acceptable engage/disengage forces for the interface;
4) insure no detrimental physical or chemical effects on the interface components;
5) remain operable after elevated temperatures and environmental exposures;
6) process easily and readily; and
7) are cost effective.

Prior spark plug boot greases do not meet the above-cited characteristics for one reason or another. Some greases tend to dry up and fall out of the interface over a period of time resulting in poor dielectric and mechanical properties. Powders often have higher than desired mechanical properties. Plug coatings, such as fluorotelomer, are usually much too expensive to be commercially utilized in automotive applications.

The present invention overcomes the shortcomings of the prior art spark plug boot and spark plug lubricant technology.

SUMMARY OF THE INVENTION

The invention is directed to a spark plug boot with an improved lubricant, a perfluoroalkylpolyether, which may be blended with an extender, such as a polydimethylsiloxane grease. Other components such as titanium dioxide, may be used as extenders. A mixture of ratios can be utilized for desired characteristics ranging from 100:0 to 25:75 weight percent perfluoroalkylpolyether to polydimethylsiloxane.

DETAILED DESCRIPTION

Figure 1:
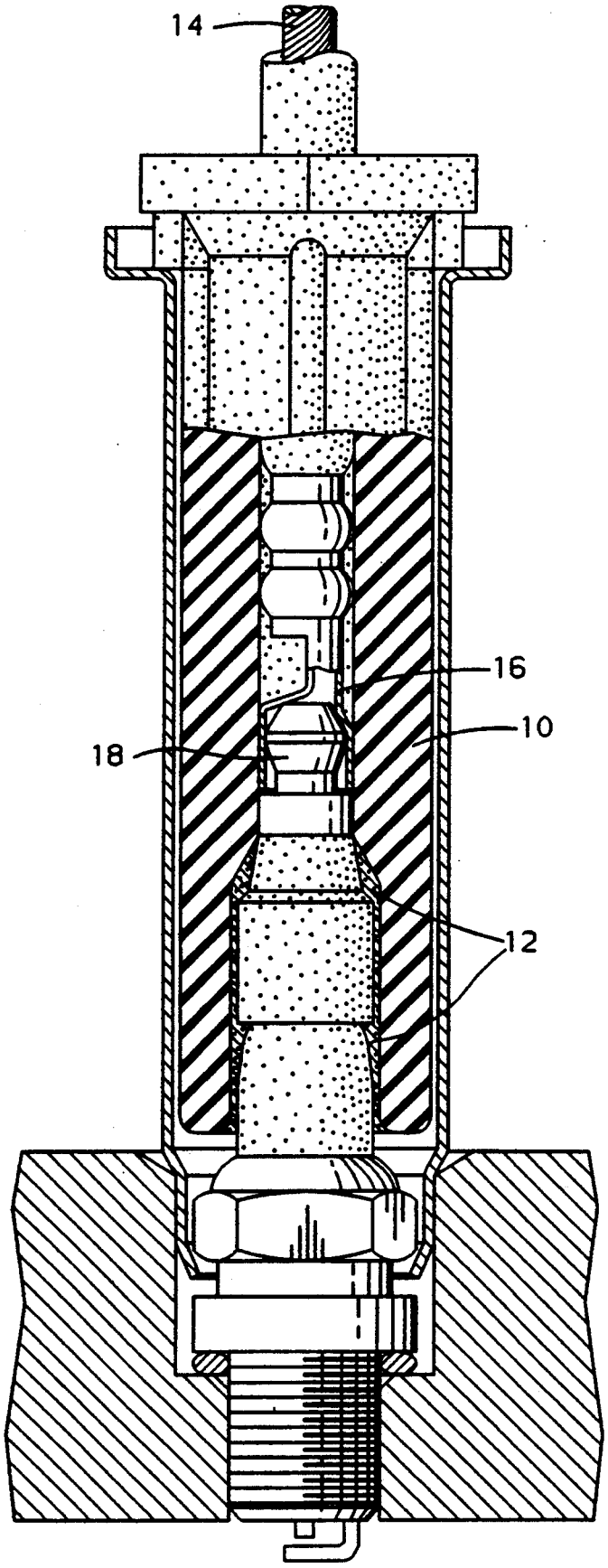
FIG. 1 is a sectional view of a spark plug boot having a lubricant according to the present invention on the portion of the walls forming the boot cavity.

FIG. 1 illustrates, in sectional view, a spark plug boot 10 having an improved lubricant 12 according to the present invention. The spark plug boot includes a spark plug wire 14 and an electrical connector 16 surrounded by the boot. The boot has a cavity formed therein for receiving a spark plug 18. A lubricant is placed on a portion of the walls forming the boot cavity, and preferably near the open end of the boot. The lubricant in this example includes a mixture of thickened perfluoroalkylpolyether and a polydimethylsiloxane grease which acts as an extender. A preferred perfluoroalkylpolyether is available from DuPont Chemicals under the trade name KRYTOX TM 205 which includes a thickener. The thickener may be a talc. A preferred silicone compound as an extender is available from Wacker Silicone Corporation under the trade name G-47 TM.

Interestingly, relatively low viscosity perfluoroalkylpolyether materials such as KRYTOX TM 201 having a viscosity of about 16 centistokes at 20° C. for the base perfluoroalkylpolyether oil, without thickener, dry within a short time and do not work well. However, higher viscosity perfluoroalkylpolyether base oil materials without thickener having a viscosity of 500 centistokes or greater (for example 500–2000 centistokes) will work very well.

The amount of perfluoroalkylpolyether to polydimethylsiloxane may vary from about 100:0 by weight to about 25:75 by weight. For example, the perfluoroalkylpolyether can be present in amounts of 25, 30, 40, 50, 60, 70, 80, 90 and 100 percent by weight of the lubricant. The two components are mixed together in a manner known to those skilled in the art.

The following examples will help illustrate the present invention.

EXAMPLE 1

A spark plug boot lubricant was prepared according to the present invention utilizing a perfluoroalkylpolyether from DuPont Chemical Corporation under the trade name KRYTOX TM (having base oil viscosity of 550 centistokes) and a polydimethylsiloxane grease available from Wacker Silicone Corporation under the trade name G-47 TM. The two components were blended in a ratio of 50:50 by weight of perfluoroalkylpolyether to polydimethylsiloxane grease. The lubricant was designated "Sil-692" and placed on a portion of the wall forming a cavity of an elastomeric spark plug boot.

EXAMPLE 2

A spark plug boot lubricant was prepared utilizing polydimethylsiloxane from Wacker Silicone Corporation under the trade name G-47 TM and utilized on a spark plug boot in a manner similar to that described in Example 1. This lubricant is hereafter referred to as "grease".

EXAMPLE 3

A spark plug lubricant was prepared from polytetrafluoroethylene dispersion available from DuPont Corporation under the trade name Vydax TM. The lubricant was applied to a spark plug. This lubricant is hereafter referred to as "fluorotelomer".

EXAMPLE 4

A spark plug boot was lubricated utilizing a titanium dioxide material available from SCM Corporation under the trade name Tiona-RCL9 TM. The material was swabbed on the spark plug boot. This lubricant is hereafter referred to as "powder".

In each of the following Examples 5–7, the spark plug boot with lubricant or powder and plug inserted in the boot were aged in an oven for two weeks at 204° C. prior to the described testing.

EXAMPLE 5

In this example the four spark plug boot lubricants were tested for dielectric breakdown by the steps similar to SAE J2032-3.4.2. After the above-described aging, the exposed portion of the plug was insulated with an epoxy. The insulated plug and boot end with lead were submerged into grounded water. Voltage was applied to the opposite end of the lead at a steadily increasing rate until the lead broke down by grounding out to the water. The breakdown voltage was then recorded. The results of the test are provided in Table 1.

TABLE I

| | (Dielectric Breakdown) Kv(rms) |
|---|---|
| Grease | 18 |
| Fluorotelomer | 32 |
| Powder | 33 |
| Sil-692 | 39 |

EXAMPLE 6

In this example the engagement force of spark plug boot was measured by the steps similar to SAE J2032-3.2.2. After the above-described aging, the plug was removed from the boot. The same plug was inserted into the boot and the force required to insert (engage) the plug into the boot was recorded. The results of the test are set forth in Table II.

TABLE II

| | (Engage Force) Newtons |
|---|---|
| Grease | 151 |
| Fluorotelomer | 90 |
| Powder | 160 |
| Sil-692 | 85 |

EXAMPLE 7

In this example the disengage force for spark plug boot/spark plug was measured by the stems similar to SAE J2032-3.2.2. After the above-described aging, the plug was removed (disengaged) from the boot and the force required to remove the plug was recorded. The results are set forth in Table III.

TABLE III

| | (Disengage Force) Newtons |
|---|---|
| Grease | 182 |
| Fluorotelomer | 173 |
| Powder | 210 |
| Sil-692 | 140 |

As can be seen, the lubricant of the present invention which utilizes a combination of perfluoroalkylpolyether and a polydimethylsiloxane grease has improved performance in dielectric breakdown, engagement and disengagement forces.

The embodiments of the invention in which an exclusive property or privilege is claimed are defined as follows:

1. An elastomeric spark plug boot including a lubricant applied to a portion of the walls forming the spark plug boot cavity wherein said lubricant comprises a perfluoroalkylpolyether and a silicone extender.

2. An elastomeric spark plug boot including a lubricant as set forth in claim 1 wherein said extender comprises polydimethylsiloxane grease.

3. An elastomeric spark plug boot including a lubricant as set forth in claim 2 wherein said perfluoroalkylpolyether and polydimethylsiloxane grease are present in a weight ratio ranging from about 90:10 to about 25:75 respectively.

4. An elastomeric spark plug boot including a lubricant as set forth in claim 1 wherein said perfluoroalkylpolyether has a viscosity ranging from about 500–2000 centistokes.

5. An elastomeric spark plug boot including a lubricant as set forth in claim 3 wherein said perfluoroalkylpolyether has a viscosity of at least 500 centistokes.

6. An elastomeric spark plug boot including a lubricant applied to a portion of the walls forming the spark plug boot cavity wherein said lubricant comprises a perfluoroalkylpolyether and a silicone extender present in a 1:1 weight ratio.

* * * * *